US006976636B2

(12) United States Patent
Thweatt, Jr.

(10) Patent No.: US 6,976,636 B2
(45) Date of Patent: Dec. 20, 2005

(54) HEATER HAVING OVER TEMPERATURE SHUT OFF CONTROL

(75) Inventor: Carlisle Thweatt, Jr., South Haven, MI (US)

(73) Assignee: TruHeat, Inc., Allegan, MI (US)

( * ) Notice: Subject to any disclaimer, the term of this patent is extended or adjusted under 35 U.S.C. 154(b) by 133 days.

(21) Appl. No.: 10/755,797

(22) Filed: Jan. 12, 2004

(65) Prior Publication Data

US 2005/0150966 A1 Jul. 14, 2005

(51) Int. Cl.[7] ..... F25B 37/42; H05B 3/02
(52) U.S. Cl. ..... 236/21 B; 236/21 R; 219/481
(58) Field of Search ..... 236/21 B, 21 R; 219/481, 480, 508, 512; 392/485, 488

(56) References Cited

U.S. PATENT DOCUMENTS 6,080,973 A 6/2000 Thweatt, Jr. ..... 219/497
6,555,796 B1 4/2003 Cusack ..... 219/481

OTHER PUBLICATIONS

"10H Series Linear Limit Thermostat" from Therm-O-Disc, Bulletin No. 10H-0195, 1995, 2 pages.

*Primary Examiner*—Chen Wen Jiang
(74) *Attorney, Agent, or Firm*—Price, Heneveld, Cooper, DeWitt & Litton, LLP

(57) ABSTRACT

A heater is provided with an accurate shutoff device that shuts off (de-energized) the heater upon detecting an over temperature condition. The heater includes a body for holding material (water) to be heated and a first heating element coupled to the body for heating material within the body. The heater also includes a temperature sensitive element coupled to the body for sensing temperature, and a shutoff switch coupled to the temperature sensitive element for shutting off the first heating element when the temperature sensitive element senses a temperature limit. The heater further includes a second heating element for heating the temperature sensitive element upon activation of the switch such that the first heating element is actively forced to remain shut off.

24 Claims, 5 Drawing Sheets

HEATER HAVING OVER TEMPERATURE SHUT OFF CONTROL

BACKGROUND OF THE INVENTION

The present invention generally relates to electric heaters and, more particularly, to a heater, such as an electric powered water heater, having over temperature shutoff controls.

Electric powered flow-through water heaters are commonly employed to heat fluid, such as water for use in jetted bathtubs, spas/hot tubs, and other heated water applications by heating water flowing through a hollow vessel. Electric water heaters typically include an electric powered heating element arranged in heat transfer relationship with the water flowing within the vessel. In many conventional flow-through water heating systems, one or more thermostats are thermally coupled to the water flowing in the vessel to sense temperature of the water, and the heating element is generally controlled based on the sensed water temperature so as to maintain a desired water temperature. Examples of water heaters are disclosed in U.S. Pat. Nos. 6,080,973 and 6,555,796, the disclosures of which are hereby incorporated herein by reference.

Conventional electric water heaters employed in jetted bathtubs and spas/hot tubs are generally controlled in response to sensed water temperature to maintain a user selectable water temperature in the heated water tub. In many jetted bathtubs, a maximum user selectable upper temperature limit of about 104° F. is typically established according to industry standards. In addition to controlling the heating element to achieve the user selected water temperature, it is also desirable to insure adequate operation of the water heater to prevent an excessive over temperature condition (i.e., overheating and problems that can arise therefrom). For example, in the event that a failure occurs in the heater controls (e.g., a thermostat), the water temperature may exceed a maximum upper temperature limit. The water heater may quickly overheat and experience an over temperature condition when there is an inadequate amount of water present in the heater vessel. Advanced overheating may also occur when there is inadequate water flow through the heater vessel, such as may be caused by the failure of a water pump or other water flow restriction.

In order to prevent the presence of an excessive over temperature condition, some conventional water heaters are generally equipped with a temperature actuated shutoff device that discontinues power supplied to the heating element when a predetermined upper temperature limit is reached. Conventional temperature-based shutoff devices include a snap disc thermal switch connected in series with the power supply input of the electrically operated heating element. The snap disc thermal switch is designed to switch from a normally closed position to an open position to open circuit the power line supplying electric current to the heating element upon detecting a predetermined upper temperature limit. Spas and hot tubs employing the snap disc thermal switch typically have a manually depressible reset button, and require that a user must depress the reset button to reset the heater in order to allow the heater to be energized following an over temperature shut off condition.

Additionally, some heaters are equipped with a pressure sensor located within the heater vessel to sense pressure or fluid flow within the vessel. The sensed pressure and/or fluid flow is used to determine if inadequate water is passed in thermal communication with the heating element. The requirement of multiple temperature sensors and a pressure sensor adds to the cost and complexity of the heater.

It is therefore desirable to provide for a heater having a shutoff control device that is cost affordable and effectively provides over temperature shut off control of the heater upon experiencing an over temperature condition.

SUMMARY OF THE INVENTION

In accordance with the teachings of the present invention, a heater is provided with a shutoff device that de-energizes (shuts off) the heater upon detecting an over temperature condition. The heater includes a body for holding material to be heated and a first heating element coupled to the body for heating material within the body. The heater also includes a temperature sensitive element coupled to the body for sensing temperature, and a switch coupled to the temperature sensitive element for de-energizing the first heating element when the temperature sensitive element senses a temperature limit. The heater further includes a second heating element for heating the temperature sensitive element upon activation of the switch such that the first heating element is actively forced to remain de-energized.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
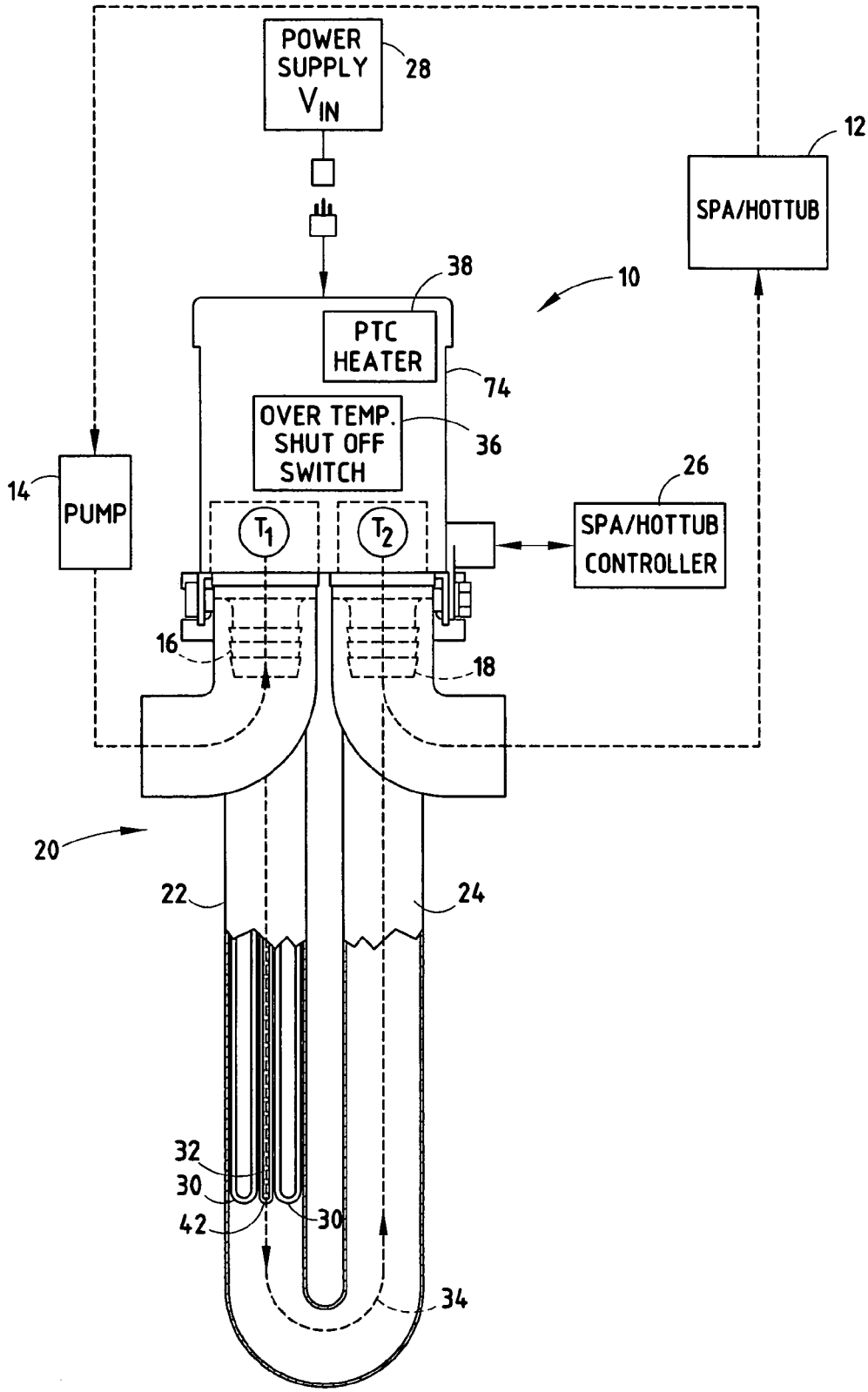
FIG. 1 is a schematic diagram illustrating a spa/hut tub employing an electric water heater shown in partial cut-away view having over temperature controls according to the present invention.
Figure 2:
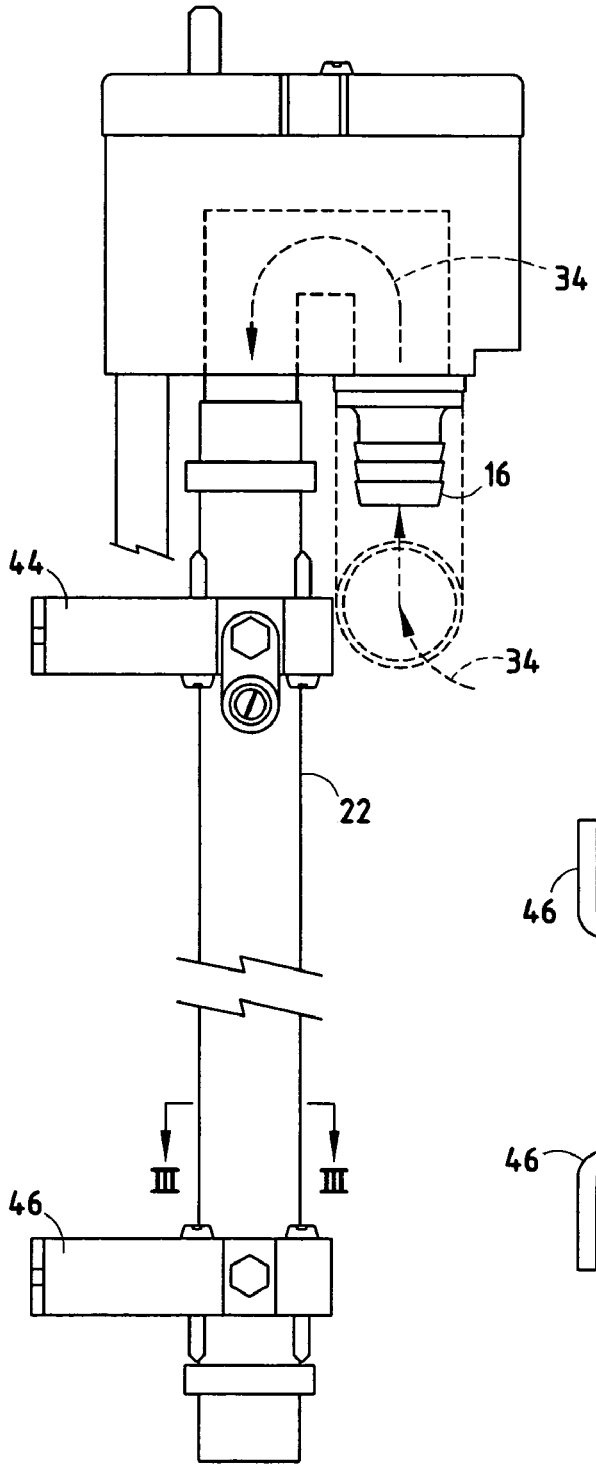
FIG. 2 is a side view of the electric water heater shown in FIG. 1.

Referring to FIGS. 1 and 2, an electric water heater 10 having over temperature shutoff controls is generally illustrated for heating water for use in a heated water tub, such as a spa/hot tub 12 or a jetted bathtub. The heater 10, in the embodiment shown and described herein, is a flow-through water heater in which water from the tub 12 is circulated by way of a pump 14 through the water heater 10. During normal heating operation, the circulating water passes into inlet 16 and is heated in the heater 10 as it flows past an electric heating element 30. The heated water then flows out of outlet 18 and is circulated back into the spa/hot tub 12. While the water heater 10 is illustrated and described herein as a flow-through water heater for use in heating water in a spa/hot tub 12 or jetted bathtub, it should be appreciated that the heater 10 according to the present invention may alternately include different types of heaters configured in various shapes and sizes and may be used in various other applications to heat various fluid and solid materials.

The heater 10 as shown generally includes a body in the form of a hollow vessel 20 having cylindrical walls defining a volume for holding material (e.g., water) to be heated when the electric heating element 30 is energized. The heater vessel 20 may be made of stainless steel, titanium, polymeric materials such as polyvinyl chloride (PVC) or other suitable materials. The heater 10 also includes a polymeric housing 74 containing electrical terminal connections and over temperature controls. Brackets 44 and 46 are shown connected to vessel 20 for mounting the heater 10 to a supporting structure.

The electric heating element 30 is thermally coupled to the vessel 20 for transferring thermal energy to the water to heat the water within the vessel 20. The electric heating element 30 may include a single-phase or a multiple-phase heater receiving electrical power from a single-phase or a multiple-phase power supply $V_{IN}$ 28. The heating element 30 may be disposed within the vessel 20 and in direct contact with the water as shown. Alternately, heating element 30 may be disposed on the outer wall of a thermal (heat) conductive vessel 20 for indirectly heating the water via thermal conduction through the vessel 20.

The heater vessel 20 is shown having a folded pair of generally parallel cylindrical tubes 22 and 24 folded at one end and defining a flow path 34. Opposite the folded ends of tubes 22 and 24 are input 16 and outlet 18, respectively. The inlet 16 and outlet 18 are each shown having a receptacle for matingly engaging a sleeve of a hose or other connector to allow fluid to flow into inlet 16 through tubes 22 and 24 and exit via outlet 18. While the hollow vessel 20 is shown and described herein having a folded pair of cylindrical tubes 22 and 24, it should be appreciated that the vessel 20 may alternately be configured as a body in various other configurations.

Coupled in fluid communication with inlet 16 is a first temperature sensor $T_1$ for sensing inlet temperature of the water exiting the tub 12 and entering the heater 10. Additionally, a second temperature sensor $T_2$ is coupled to the outlet 18 for sensing outlet temperature of the water exiting the heater 10 for return to the tub 12. A spa/hot tub controller 26 is also shown coupled to the heater 10 for controlling operation of the heater 10 during normal heating operation of the spa/hot tub 12. This may include processing the temperature signals sensed via inlet and outlet temperature sensors $T_1$ and $T_2$, respectively, and controlling energization of the heating element 30 via a switch or other power control device. The inlet temperature sensed with temperature sensor $T_1$ may be processed by controller 26 to maintain a desired (e.g., user selectable) temperature of the spa/hot tub 12 (e.g., 104°). The outlet temperature sensed with temperature sensor $T_2$ may be processed by controller 26 to prevent the outlet temperature of the water from exceeding a scalding temperature (e.g., 117°). Accordingly, the spa/hot tub controller 26 may control energization of the heating element 30 to maintain the spa/hot tub 12 at the desired hot tub temperature setting and to prevent scalding water from being generated by the heater 10 and returned to the tub 12.

The heater 10 according to the present invention is equipped with over temperature controls for preventing the heating element 30 from generating an excessive temperature, such as 145° F., according to one example. The over temperature controls include a temperature sensing element 32 disposed in heater vessel 20 for sensing the temperature within the vessel 20, particularly in tube 22. Additionally, the over temperature controls include an over temperature shutoff switch 36 coupled to the temperature sensing element 32. The over temperature shutoff switch 36 provides a switch to de-energize (shut off) electrical power supplied to the heating element 30 upon detecting an over temperature condition. The over temperature controls further include a positive temperature coefficient (PTC) heater 38 which serves as an active heating element to heat the temperature sensing element 32 upon activation of the over temperature shutoff switch 36 such that the heating element 30 is actively forced to remain de-energized (shut off). By forcing the main heating element 30 to remain shut off, the PTC heater 38 provides an active control mechanism to ensure that the heater 10 is not able to be re-energized unless the heater 10 sufficiently cools such that the temperature of the temperature sensing element 32 drops below a drop back temperature (e.g., 120° F.) and the heater 10 is electrically disconnected from the electrical power supply $V_{IN}$ 28, such as by unplugging the electrical input terminals from the power supply outlet.

Figure 3:
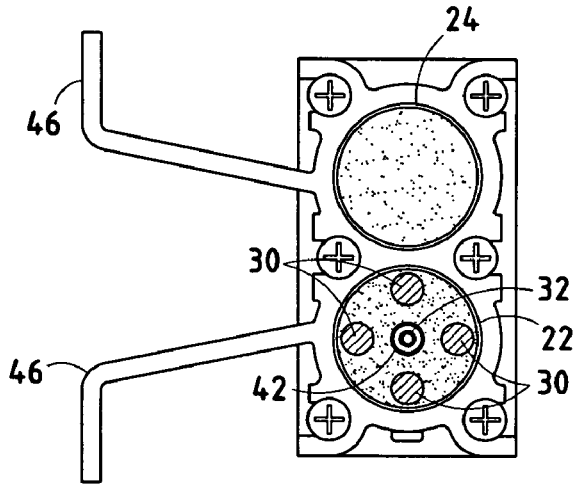
FIG. 3 is a cross-sectional view of the heater vessel taken through lines III—III of FIG. 2.
Figure 4:
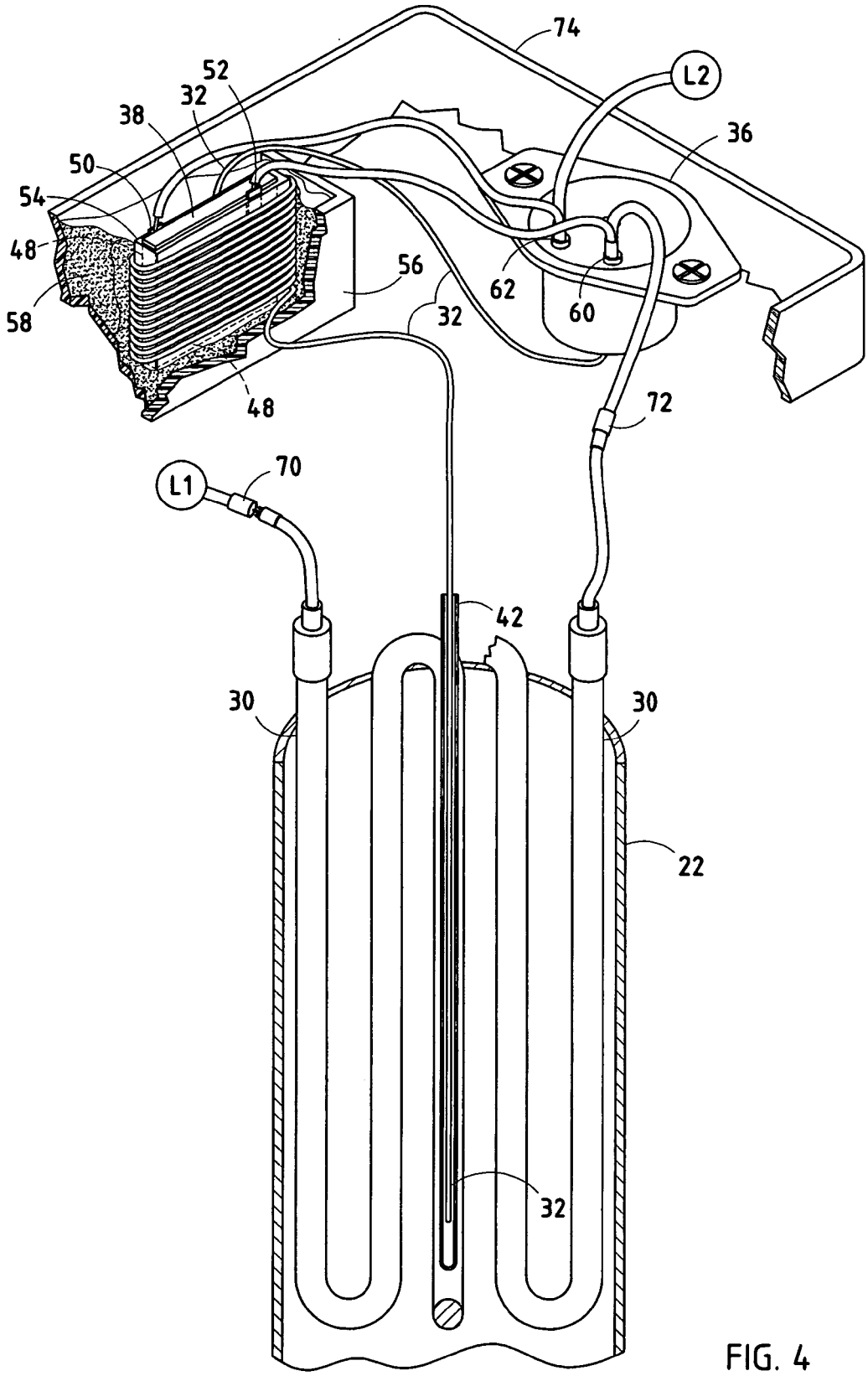
FIG. 4 is a cut-away view of the heater assembly and over temperature controls.

Referring to FIGS. 3 and 4, the electric heating element 30 is shown configured in a double-folded arrangement having four elongated portions extending through a portion of tube 22. The four elongated portions of heater 30 are shown equiangularly disposed and offset approximately ninety degrees (90°) from each other. The heating element 30 has a pair of electrical terminals 70 and 72 at opposite ends that are connected to an electrical power supply that supplies electric current through the heating element 30. According to one example, electric heating element 30 may have a power rating of about a 6,000 watts and an electrical resistance of about 10 ohms and is powered by single-phase or multiple-phase electric current. Any of a variety of heating elements may be employed to heat the material (e.g., water).

The temperature sensing element 32 is disposed within a surrounding thermally conductive (e.g., metal) tube 42 that extends into the hollow of vessel tube 22. In the embodiment shown, thermally conductive tube 42 and temperature sensing element 32 extend centrally through a portion of vessel tube 22 and are spaced from the elongated portions of heating element 30. Temperature sensing element 32 senses temperature of the material flowing through tube 22.

As seen in the embodiment shown in FIG. 4, the temperature sensing element 32 is provided as a capillary tube sensing element which is thermally coupled to both PTC heater 38 and over temperature shutoff switch 36. In particular, the capillary tube 32 is wrapped around the PTC heater 38 by N-number of turns to provide a thermal coupling. When the PTC heater 38 is energized, heater 38 heats capillary tube sensing element 32 such that the temperature sensed via sensing element 32 is elevated. Once the temperature sensed by the temperature sensing element 32 is sufficiently elevated above the over temperature (e.g., 145° F.), the shutoff switch 36 is forced into an open position which causes the heating element 30 to remain shut off. The PTC heater 38 serves as an active heat source to maintain the shutoff switch 36 in the open position.

The PTC heater 38 is shown as a rectangular-shaped heater having electrical contact surfaces 48 on opposite sides which may each include an ohmic silver coating. Disposed in contact with contact surfaces 48 are first and second electrical contacts 50 and 52 for supplying electrical current through the PTC heater 38. The PTC heater 38 has a positive temperature coefficient (PTC) such that the resistance of PTC heater 38 varies with temperature and, accordingly, the amount of power required to heat the heater 38 also changes with temperature. According to one example, the PTC heater 38 has a power rating of about 10 watts at 70° F. and a power rating of about 1 watt at 200° F. One example of a PTC heater 38 includes Model No. PR661E120S402A, commercially available from Advanced Thermal Products.

The PTC heater 38 is disposed within a compartment 56 in the control housing 74. Surrounding the outer surface of contact surfaces 48 and contacts 52 and 54 is a dielectric insulator 54. Insulator 54 may include a polymeric (plastic) sleeve that dielectrically separates the PTC heater 38 and contacts 52 and 54 from the overwrapped temperature sensing element 32 to prevent electrical short circuiting therebetween. Additionally, the compartment 56 may include an electrically insulated medium 58, such as magnesium oxide, disposed therein to thermally couple PTC heater 38 and temperature sensing element 32 to enhance the heat transfer relationship. The magnesium oxide medium 58 provides enhanced thermal conductivity and may extend through openings (not shown) in insulator 54.

Figure 5:
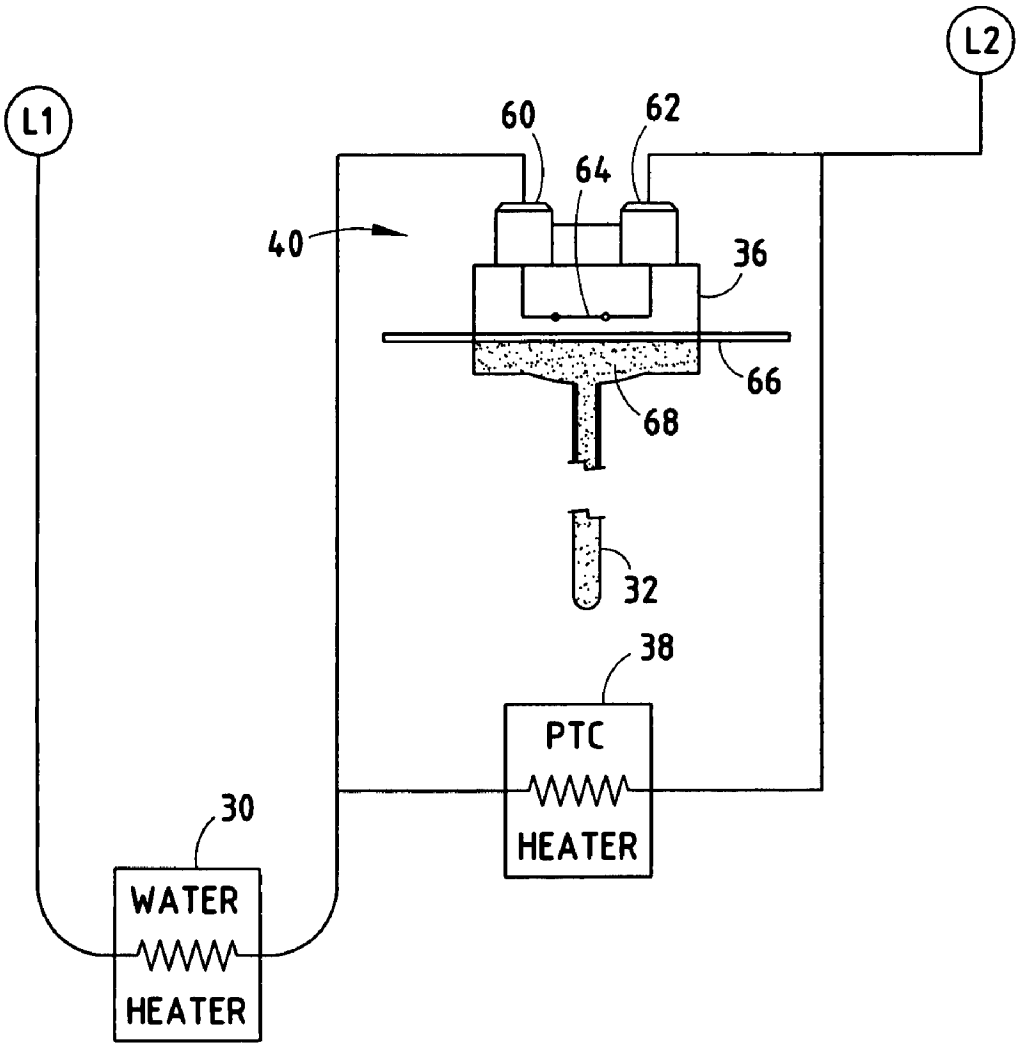
FIG. 5 is a schematic diagram further illustrating the over temperature controls including a cross-sectional view of a linear limit switch in the closed position.

Referring to FIG. 5, the arrangement of the water heater 30, PTC heater 38, and a shutoff switch 36 is further shown therein. In the embodiment shown, the shutoff switch 36 and temperature sensing element 32 are integrally formed as a linear limit thermostat 40. One example of a linear limit thermostat 40 includes an automatic reset linear limit thermostat of type 10H11, commercially available from Thermo-O-Disc, Inc., a subsidiary of Emerson Electric Company.

The linear limit thermostat 40 employs a snap action disc (diaphragm) 66 and switch 64 that operates as the shutoff switch 36, and also employs a capillary tube as the temperature sensing element 32. The snap action diaphragm 66 is disposed in communication with a sealed volume of fluid 68 and is positioned so as to open switch 64 when forced from a first position into a second position. The capillary tube 32 is vacuum charged with fluid to give a specific calibration temperature. When the calibration temperature (over temperature) is reached, a change in fluid vapor pressure allows the snap action diaphragm 66 to snap through from a first position to a second position which operates contacts on switch 64.

As seen in FIG. 5, the switch 64 is shown in a normally closed position to allow electric current to flow from terminal L1 through water heater 30 to pass through switch 64 via contacts 60 and 62 and to terminal L2. It should be appreciated that the 6,000 watt water heater 30 has an electrical resistance of approximately 10 ohms, in contrast to a resistance of approximately 10,000 ohms at about 200° F. for the PTC heater 38. Consequently, when switch 64 is closed, electric current flows through water heater 30 and switch 64 and substantially bypasses the PTC heater 38, such that PTC heater 38 is essentially not energized.

Figure 6:
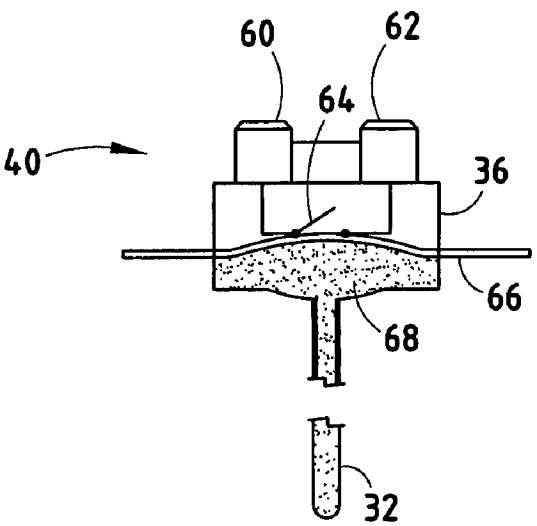
FIG. 6 is a cross-sectional view of the linear limit switch in the open position.

The linear limit thermostat 40 operates such that the capillary tube 32 containing a fluid, such as a solution of thirty-three percent (33%) acetone and sixty-seven percent (67%) water, upon reaching the over temperature, boils and expands to a pressure sufficient to cause the snap disc diaphragm 66 to move from a first position in which switch 64 is closed to a second position in which the switch 64 is forced to an open position, as shown in FIG. 6. When this occurs, switch 64 opens so as to prevent electrical current from passing through terminals L1 and L2. Instead, the electric current is forced to pass through both water heater 30 and PTC heater 38. Because the PTC heater 38 has a much higher resistance (on the order of about 1,000 times greater), the PTC heater 38 is essentially energized while water heater 30 is essentially de-energized (shut off). Energization of PTC heater 38 causes thermal energy (heat) to be transferred to the temperature sensing element 32 to actively maintain the water heater 30 in the de-energized shutoff state.

In operation, the normally closed switch 64 remains closed and the water heater 30 is electrically energized to heat water in vessel 20 in a controlled fashion so as to maintain a user selected temperature of the water in the spa/hot tub 12. When operating in normal temperature conditions, the PTC heater 38 remains shut off because electrical current bypasses the heater 38 through switch 64. In the event that a failure is present in the normal spa/hot tub temperature controls, the over temperature controls provide backup shut off capability to prevent overheating of the heater 10. When the sensed temperature of the heater reaches an over temperature threshold, such as a temperature of 145° F., the fluid 68 within capillary tube 32 boils and expands so as to cause the snap disc diaphragm 66 to force contacts on switch 64 to move from a normally closed position to an open position. This, in turn, energizes the PTC heater 38 and causes the electric heater 30 to essentially be turned off (de-energized), so as to prevent further heating of the water in the heater 10.

Upon energization of the PTC heater 38, heater 38 begins to heat up so as to heat the temperature sensing element 32 to an elevated temperature. In one embodiment, the PTC heater 38 may take approximately three minutes to heat to a temperature sufficient to maintain the shutoff switch 36 in the open position. Within the initial three minute window, it is possible for the shutoff switch 36 to be reset upon the temperature sensing element sensing a temperature of less than the drop off temperature, such as 120° F., at which point the snap disc diaphragm 66 returns from its second position to its first position. Thus, a minor overheat condition may result in the resetting of switch 64 so as to allow continued use of the electric heater 30.

Once the PTC heater 38 is sufficiently heated, the PTC heater 38 actively operates to maintain the elevated temperature state of the temperature sensing element 32. This causes the electric heater 30 to remain actively de-energized (shut off), even if the temperature subsequently drops below the drop off temperature. In this state, the user is required to deactivate the power supply $V_{IN}$ to de-energize the PTC heater 38 and allow the snap disc diaphragm 66 to cool to a temperature below the drop off temperature. Thereafter, upon reactivating the voltage supply $V_{IN}$, the heater 10 may be energized.

Figure 7:
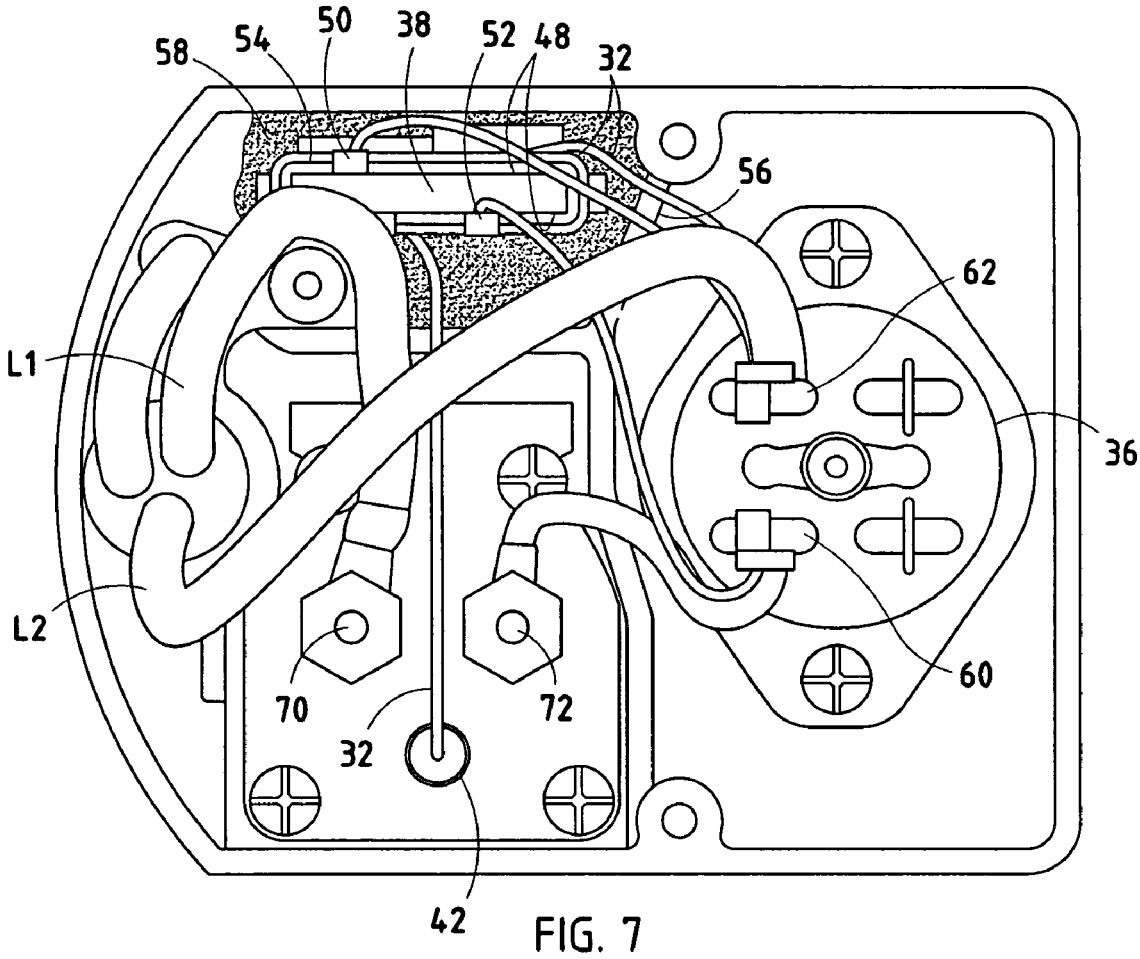
FIG. 7 is an end view of the electric water heater shown in FIG. 1 further illustrating assembly of the heater and shutoff controls.

Referring to FIG. 7, the over temperature controls and connection to heater 30 are illustrated therein, according to one example. As seen, the housing 74 contains the assembly of the shutoff switch 36, terminals 70 and 72 of heater 30, input lines L1 and L2, and the PTC heater 38. While the shutoff control hardware and circuitry have been shown according to one embodiment, it should be appreciated that other various configurations and arrangements of the over temperature controls may be provided in a heater, without departing from the present invention.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A heater having a high temperature shut off comprising:

a body for holding material to be heated;

a first heating element coupled to the body for heating material within the body;

a temperature sensitive element coupled to the body for sensing temperature;

a switch coupled to the temperature sensitive element for de-energizing the first heating element when the temperature sensitive element senses a temperature limit; and a second heating element for heating the temperature sensitive element upon activation of the switch such that the first heating element is actively forced to remain de-energized.

2. The heater as defined in claim 1, wherein the switch comprises a thermal switch having an open position and a closed position.

3. The heater as defined in claim 2, wherein the thermal switch comprises a temperature sensitive snap disc.

4. The heater as defined in claim 1, wherein the second heating element has a positive temperature coefficient such that the resistance of the second heating element varies with temperature.

5. The heater as defined in claim 1, wherein the heater is a water heater.

6. The heater as defined in claim 5, wherein the water heater is employed in one of a hot tub and spa.

7. The heater as defined in claim 1, wherein the body comprises an elongated hollow for providing flow-through heating.

8. The heater as defined in claim 1, wherein the second heating element is thermally coupled to the temperature sensitive element.

9. The heater as defined in claim 1, wherein the temperature sensitive element and switch comprise a linear limit thermostat comprising a capillary tube and a snap action member.

10. A flow through water heater comprising:

an elongated hollow body for holding water to be heated;

a first heating element coupled to the body for heating water within the body;

a temperature sensitive element coupled to the body for sensing temperature of the water;

a shutoff switch coupled to the temperature sensitive element for de-energizing the first heating element when the temperature sensitive element senses a temperature limit; and a second heating element for heating the temperature sensitive element upon activation of the switch such that the heater is forced to remain de-energized.

11. The heater as defined in claim 10, wherein the shutoff switch comprises a thermal switch having an open position and a closed position.

12. The heater as defined in claim 11, wherein the thermal switch comprises a temperature sensitive snap disc.

13. The heater as defined in claim 10, wherein the second heating element has a positive temperature coefficient such that the resistance of the second heating element varies with temperature.

14. The heater as defined in claim 10, wherein the water heater is employed in one of a hot tub and spa.

15. The heater as defined in claim 10, wherein the second heating element is thermally coupled to the temperature sensitive element.

16. The heater as defined in claim 10, wherein the temperature sensitive element and shutoff switch comprise a linear limit thermostat comprising a capillary tube and a snap action member.

17. A method of controlling a heater to provide a high temperature shut off, said method comprising the steps of:

providing a body of material to be heated;

heating the material with a first heating element;

sensing temperature of the material with a temperature sensitive element;

de-energizing the first heating element when the temperature exceeds a temperature limit; and heating the temperature sensitive element with a second heating element upon de-energizing the first heating element such that the first heating element is forced to remain de-energized.

18. The method as defined in claim 17, wherein the step of de-energizing the first heating element comprises actuating a switch upon the sensed temperature exceeding the temperature limit.

19. The method as defined in claim 18 further comprising the step of actuating the switch to a second position upon the sensed temperature dropping to a lower temperature limit.

20. The method as defined in claim 19, wherein said first heating element is energized when the switch returns to its first position.

21. The method as defined in claim 17 further comprising the steps of removing power to the first and second heating elements, and energizing the first heating element upon the temperature dropping below a lower temperature limit.

22. The method as defined in claim 17, wherein said step of heating with a second heating element comprises heating with a positive temperature coefficient heating element such that the resistance of the second heating element varies with temperature.

23. The method as defined in claim 17, wherein the body of material comprises water.

24. The method as defined in claim 23, wherein the heater is employed to heat water in one of a hot tub and spa.

* * * * *